United States Patent [19]

Beckwith

[11] Patent Number: 4,759,549

[45] Date of Patent: Jul. 26, 1988

[54] BOARD GAME

[76] Inventor: Lester E. Beckwith, 10120 E. 22nd. Pl., Tulsa, Okla. 74129

[21] Appl. No.: 72,433

[22] Filed: Jul. 13, 1987

[51] Int. Cl.[4] ..... A63F 3/00

[52] U.S. Cl. ..... 273/274; 273/247; 273/249

[58] Field of Search ..... 273/247, 249, 274

[56] References Cited

U.S. PATENT DOCUMENTS

| | | | |
|---|---|---|---|
| 3,853,322 | 12/1974 | Mercer . | |
| 4,010,957 | 3/1977 | Tricoli . | |
| 4,019,737 | 4/1977 | Witzel | 273/94 |
| 4,108,361 | 8/1978 | Krause . | |
| 4,141,548 | 2/1979 | Everton | 273/94 X |
| 4,569,529 | 2/1986 | Gibbs | 273/274 |
| 4,706,959 | 11/1987 | Price | 273/274 X |

*Primary Examiner*—Anton O. Oechsle

*Attorney, Agent, or Firm*—Robert B. Stevenson

[57] ABSTRACT

A board game that simulates repeated betting and wagering on a series of sporting event games throughout an actual season involving a playing board and indicia on the board representing each player wherein the playing board is graduated to reflect the cumulative number of winning and losing bets by each player relative to a starting position. During play of the board game, each player is assigned a starting number of points and receives on a periodic basis (e.g. weekly) a game and risk card upon which the player enters selections of winners and the amount of points being wagered relative to a series of actual future sporting event games. The position of the indicia on the playing board and the assigned number of points of each player are periodically adjusted to reflect the net number of winners and losers selected and net wagers won and lost, respectively, thus simulating the course of betting throughout the sporting event season.

4 Claims, 3 Drawing Sheets

GAME AND RISK CARD

| TEAM | | BET | | | | |
|---|---|---|---|---|---|---|
| | | 10,000 | 5,000 | 1,000 | 500 | 100 |
| 1.0 | 2.0 | 000 | 000 | 000 | 000 | 00000 |
| 3.0 | 4.0 | 000 | 000 | 000 | 000 | 00000 |
| 5.0 | 6.0 | 000 | 000 | 000 | 000 | 00000 |
| 7.0 | 8.0 | 000 | 000 | 000 | 000 | 00000 |
| 9.0 | 10.0 | 000 | 000 | 000 | 000 | 00000 |
| 11.0 | 12.0 | 000 | 000 | 000 | 000 | 00000 |
| 13.0 | 14.0 | 000 | 000 | 000 | 000 | 00000 |
| 15.0 | 16.0 | 000 | 000 | 000 | 000 | 00000 |
| 17.0 | 18.0 | 000 | 000 | 000 | 000 | 00000 |
| 19.0 | 20.0 | 000 | 000 | 000 | 000 | 00000 |
| 21.0 | 22.0 | 000 | 000 | 000 | 000 | 00000 |
| 23.0 | 24.0 | 000 | 000 | 000 | 000 | 00000 |
| 25.0 | 26.0 | 000 | 000 | 000 | 000 | 00000 |
| 27.0 | 28.0 | 000 | 000 | 000 | 000 | 00000 |
| 29.0 | 30.0 | 000 | 000 | 000 | 000 | 00000 |
| 31.0 | 32.0 | 000 | 000 | 000 | 000 | 00000 |
| 33.0 | 34.0 | 000 | 000 | 000 | 000 | 00000 |
| 35.0 | 36.0 | 000 | 000 | 000 | 000 | 00000 |
| 37.0 | 38.0 | 000 | 000 | 000 | 000 | 00000 |
| 39.0 | 40.0 | 000 | 000 | 000 | 000 | 00000 |
| 41.0 | 42.0 | 000 | 000 | 000 | 000 | 00000 |
| 43.0 | 44.0 | 000 | 000 | 000 | 000 | 00000 |

FIG. 2

PLAYER'S SCOREBOARD

| | WIN/LOSS RECORDS | | | | POINT TOTALS | | | |
|---|---|---|---|---|---|---|---|---|
| WEEK | WON | GAMES LOST | (+,-) MOVE | BONUS | WON/ +BONUS | SUB-TOTAL | LOST/ -BONUS | NEW TOTAL |
| 1 | | | | | + | | - | |
| 2 | | | | | + | | - | |
| 3 | | | | | + | | - | |
| 4 | | | | | + | | - | |
| 5 | | | | | + | | - | |
| 6 | | | | | + | | - | |
| 7 | | | | | + | | - | |
| 8 | | | | | + | | - | |
| 9 | | | | | + | | - | |
| 10 | | | | | + | | - | |
| 11 | | | | | + | | - | |
| 12 | | | | | + | | - | |
| 13 | | | | | + | | - | |
| 14 | | | | | + | | - | |
| 15 | | | | | + | | - | |
| 16 | | | | | + | | - | |

FIG. 3

BOARD GAME

BACKGROUND OF THE INVENTION

1. Field of the Invention

The present invention relates to a board game. More specifically, the invention relates to a board game that simulates wagering and betting on actual sporting events as the sporting events take place.

2. Background of the Invention

The basic concept of providing a game board and set of rules that define the play on the game board that simulates the actual play of a sporting event is generally known. Also, various board games that involve wagering or betting during the play of the game are known. However, to the best knowledge of the present inventor and prior to the present invention, no board game has been suggested that literally simulates the act of wagering and betting on actual sporting events as they occur employing all the skills and intellectual activities of real gambling without the monetary risk.

SUMMARY OF THE INVENTIONS

The present invention, unlike the traditional sporting event board games of the past, simulates the wagering and betting aspects of actual sporting events rather than simulating the play of the game. As such, the play of the board game according to the present invention can be viewed as an alternative to actual gambling where the players experience the fun, challenge and excitement of selecting winners and losers and wagering on actual sporting events using all the skills, intuition and foresight associated with real gambling, but without the monetary risk.

Thus, the method of playing a board game simulating betting on a sporting event, according to the present invention, comprises the steps of:

(a) providing a playing board that represents the game played associated with a seasonal sporting event wherein the playing board has graduations based on the net number of sporting event games won or lost relative to a starting position on the playing board;

(b) assigning a starting number of points to a plurality of players;

(c) providing a plurality of indicia, one for each player, at the starting position on the playing board;

(d) distributing a game and risk card to each player wherein the game and risk card identifies a series of actual future sporting event games occurring during a specified time span and provides for each player to enter a wager of player-selected number of points on each sporting event game and select the winner of each sporting event game upon which the point wager is being made;

(e) monitoring the results of the series of sporting event games identified on the game and risk card and the wagers and winner selections made by each player;

(f) computing the net gain or loss of points for each player associated with the wagers and selection of winners on the game and risk card relative to the actual outcome of the sporting event games;

(g) adjusting the number of points assigned to each of the plurality of players by an amount equal to the net gain or loss of points for each player to establish a new number of points assigned to each of the plurality of players;

(h) adjusting the position of the indicium for each player on the playing board to reflect the net number of winners and losers selected by the player relative to the actual outcome of the sporting event games; and (i) repeating steps (d) through (h) during the entire season associated with the seasonal sporting event.

It is an object of the present invention to provide a game that represents an alternative to wagering and gambling. It is a further object to provide such a game that simulates gambling by involving the players in the intellectual activity involved in betting on actual sporting events. It is a further object of the present invention to provide rewards to the players in the sense of ranking the players according to their level of performance. Fulfillment of these objects and the presence and fulfillment of additional objects will be apparent upon complete reading of the specification and claims taken in conjunction with the drawing.

BRIEF DESCRIPTION OF THE DRAWING

FIG. 2 illustrates a typical game and risk card useful in playing the football embodiment illustrated in FIG. 1.

FIG. 3 illustrates a typical player's scorecard useful in playing the football embodiment illustrated in FIG. 1.

DESCRIPTION OF THE PREFERRED EMBODIMENTS

Figure 1:
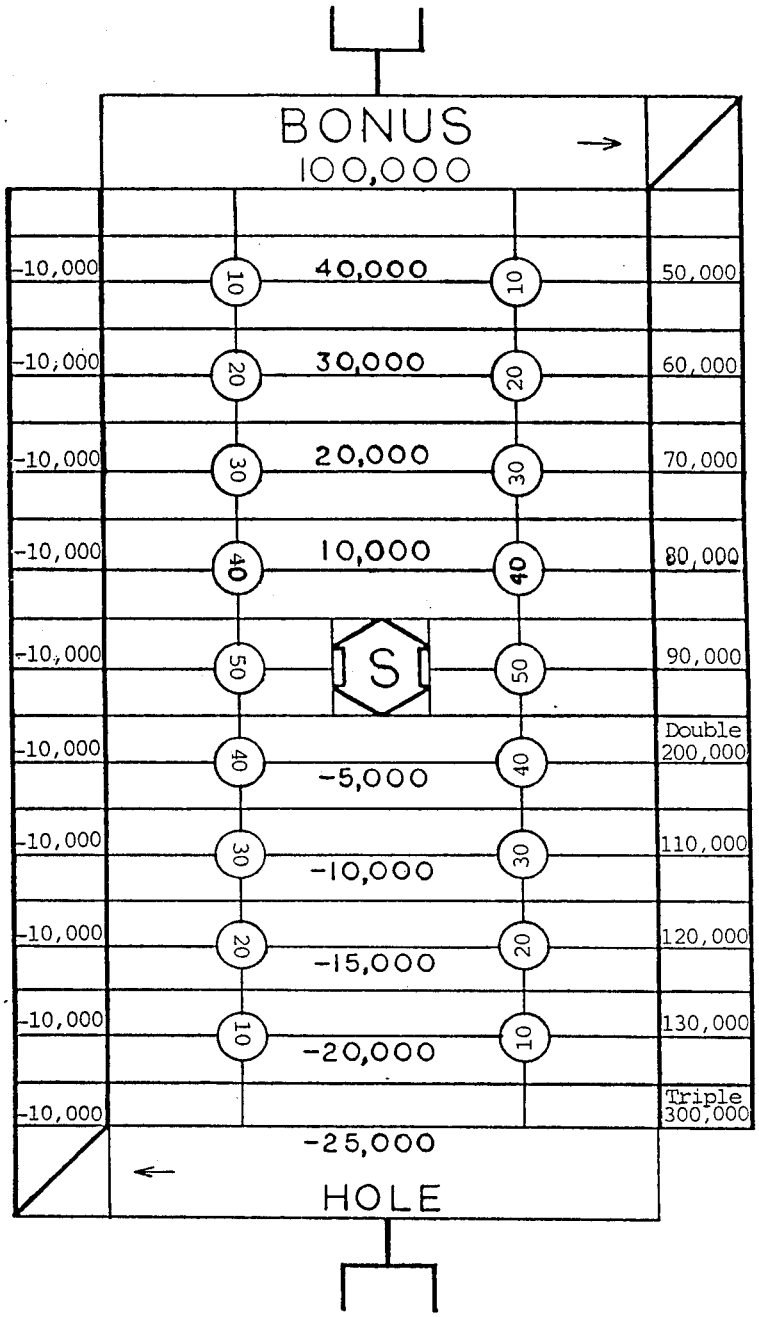
FIG. 1 illustrates one specific embodiment of a playing board, according to the present invention, useful when the sporting event is football.

The board game and method of play, according to the present invention, involves the use of a playing board that preferably resembles or physically represents the game being played; a set of playing pieces or indicia that identify the players, which are positioned on the playing board to reflect the relative degree of success or failure during the play of the game for each player; and a set of game and risk card that the players use to select game(s) being bet on and points at risk on each wager.

Typically, a player's kit will be provided which includes the game and risk cards, instructions, relevant data and information concerning the actual sporting event involved in the play, individual player scorecards and playing boards to allow each player to keep track of his wins and losses. Since the play of the board game involves actual sporting events which are to take place in the near future, the player literally selects his choice of anticipated winner of an individual sporting event which appears on the game card and selects the amount of points which he chooses to risk in the form of a bet based on the accuracy of his prediction of the actual outcome of a real sporting event. The game and risk card and the information thereon are to be collected prior to the sporting event and are used to monitor each player's success or failure. The results of the wagers are then used to assign a new position for each player's piece on the playing board and used to compute the net points accumulated or assigned to each player.

To start the game, each player is arbitrarily assigned a fixed number of points which are to be wagered by the player at his discretion. As such, the playing board will have a starting position from which a player's piece or indicium is advanced or retarded reflecting, preferably, the number of correct selections of winners or the like. Since the sporting events are actual games being played by real individuals or teams, the play of the board game by the individual player is to be enhanced, supplemented, and influenced by essentially all conventional knowledge and information utilized by sporting fans to wager, bet or predict results of such events. Thus, all conventional sources of sporting news or the like are utilized by the player to make the correct selection and amount of points being wagered.

In this respect, the play of the board game, according to the present invention, simulates very closely many of the aspects of real gambling, particularly relative to the skill, knowledge and foresight involved in predicting results of such events. Consequently, the monitoring of the results and ranking of the players will reflect, in principle, their abilities relative to other players. In addition, players can measure their individual skills relative to the benchmarks of the gambling industry by monitoring the Las Vegas odds makers, the Vegas line, and other sporting event predictions simultaneously with the play of the board game as the games are played. It is further envisioned according to the present invention that even a computer model that predicts results could be employed as a pseudo-player benchmark. All of this is accomplished without actually committing the players to any monetary risk associated with betting on individual games.

In implementing the board game, according to the present invention, it is envisioned that the game and risk cards will be prepared prior to the actual sporting event and distributed to the individual players on a periodic basis (typically, weekly) prior to the sporting event throughout the entire sporting event season. The player will then submit the selections and amount of points at risk to a central or common monitoring party or location. After the sporting event takes place, the results of the wagering will be updated on the playing board and the number of points assigned to each player will be adjusted to a new value by the monitoring party. This process will continue throughout the entire season associated with the particular sporting event, thus leading to an ultimate ranking at the end of the season for each participating player.

It is envisioned that in playing the board game with a large number of players, the entire monitoring and ranking process taking place during the season (e.g., week to week) would be interpreted by a computer and as such, the player's selection and points at risk as well as other information included on the game and risk card could be communicatead entirely online from an individual player's personal computer terminal or the like. Of course, other modes of communication, such as mailing in the game and risk card, are also contemplated when large numbers of players are involved.

To further illustrate the board game according to the present invention, the following illustrative example using football as the sporting event is presented. However, in presenting this specifically preferred embodiment, it should be understood that the concepts of the present invention are not specifically limited to any one type of sporting event and as such, the following should not be viewed as being unduly limiting.

As illustrated in FIG. 1, the football embodiment of the present invention involves a playing board that resembles a football field. The center of the board, the fifty yard line, represents the starting position upon which the player's piece is placed at the beginning of the football season. As further illustrated, the piece representing the player's success or failure is moved initially upward five yards for each correct football game prediction and downward five yards for each incorrect prediction. Associated with each ten yard advance or loss, additional bonus or penalty points, respectively, are assigned to the player. After ten more correct than incorrect predictions or the converse, ten incorrect more than correct predictions, the goal lines are crossed and the player proceeds to keep track of his performance by turning a corner in the end zone and moving back along the sideline.

The actual piece representing the individual player can be generally any incidium or symbolic piece assigned to the player. Preferably and particularly in games employing a large number of players, the player is assigned a membership number. In such large games, a computer is preferably employed to compute and keep track of each player's progress during the football season (as further described later). Also, to start the game each player is assigned a starting number of points, preferably one million points. The individual player's performance is then further monitored during the football season by continuously adjusting the cumulative points assigned to that player. The adjusting of the point total involves adding or subtracting the bonus and penalty points associated with the absolute number of predictions made correctly less incorrect predictions. The adjusting of the point total also involves adding or subtracting the points wagered on individual football games depending on whether or not the player correctly or incorrectly predicted the outcome of the football game (i.e., if the player placed a wager on the winning team).

During the play of the game, each player is allowed to bet as many of his points as he chooses on as many of the selected games specified on the particular game and risk card being played. FIG. 2 illustrates a typical game and risk card. Each of these cards is forwarded to the game coordinator before the particular specified football games are actually played. As shown on the game and risk card, there are 22 games involving 44 football teams. The specific assigned teams are published by the game coordinator in the sense that a number corresponding to the teams is selected and communicated to the individual player before the game and risk card is filled in by the player. In the specific embodiment illustrated in FIG. 2, the player merely fills in the zero to the right of the decimal point for those teams on which the player elects to place a wager. The amount to be wagered is then specified to the right of the respective game by filling the number of zeros corresponding to the units being bet. For example, filling in all 17 zeros amounts to wagering 50,000 points on that game. Filling in fewer zeros represents a correspondingly smaller wager down to a minimum of 100 points (for this particular illustrated embodiment).

The placing of a wager or more specifically the log in of a bet on the game and risk card can generally be any number of selections of winners or lack of selection of a winner (i.e., no bets) as the individual player wishes. As such, not all games have to be played. Typically and preferably the game and risk cards are submitted weekly, covering preselected football games played that week. Each game and risk card is scored on a parlay play. If a player bets on, for example, four games and wins three, losing one, the player's piece is moved forward (upward) three spaces and back one; i.e., a net gain of ten yards. All bonus points are counted after the week's play and not after each game. As such, if a player moves forward past a given point bonus level but later moves back to a space before the point bonus level, the player does not get the bonus. The player must stay past the bonus level until after that week's play. If a player moves past more than one bonus level and stays there until after that week's play, the player gets all bonus points earned. The same holds true for going past penalty levels. However, all bonus and penalty points are counted only once. When the player achieves a bonus or penalty level, his cumulative points are adjusted and that level of bonus or penalty is unavailable to that player during the rest of the football season.

The player's cumulative points are also adjusted according to the number of points wagered on the game (i.e., the number of points at risk). Preferably a tie game is treated as a loss for the points at risk on the football game; however, a push on the wager for ties is an acceptable alternative and should be considered equivalent for purposes of this invention.

In principle players may lose all their points and continue to play, as if they still had points. The game is intended to quantitatively measure the skill of the player to select and wager on that selection over the course of an entire football season using real football games but without monetary risk. Each season, the game and players start over.

As previously indicated, it is contemplated that each player can utilize all available outside sources of information to influence his particular selection of winners. Thus, the actual football games being played can be analyzed by the player in essentiallly the same manner as if a real monetary wager was to be made, including by way of example, players'talent, previous record, injuries, weather, home field advantage and the like. Also as illustrated in FIG. 3, a player's scorecard can be provided to assist the player in monitoring his performance.

Having thus described the invention with a certain degree of particularity, it is to be understood that the invention is not limited to the embodiments set forth herein for purposes of exemplification, but is to be limited only by the scope of the attached claims, including a full range of equivalents to which each element thereof is entitled.

I claim :

1. A method of playing a board game simulating betting on a sporting event comprising the steps of:

(a) providing a playing board that represents the game played associated with a seasonal sporting event wherein said playing board has graduations based on the net number of sporting event games won or lost relative to a starting position on said playing board;

(b) assigning a starting number of points to a plurality of players;

(c) providing a plurality of indicia, one for each player, at the starting position on said playing board;

(d) distributing a game and risk card to each player wherein said game and risk card identifies a series of actual future sporting event games occurring during a specified time span and provides for each player to enter a wager of player-selected number of points on each sporting event game and select the winner of each sporting event game upon which the point wager is being made;

(e) monitoring the results of said series of sporting event games identified on said game and risk card and the wagers and winner selections made by each player;

(f) computing the net gain or loss of points for each player associated with the wagers and selection of winners on said game and risk card relative to the actual outcome of said sporting event games;

(g) adjusting the number of points assigned to each of said plurality of players by an amount equal to the net gain or loss of points for each player to establish a new number of points assigned to each of said plurality of players;

(h) adjusting the position of the indicium for each player on said playing board to reflect the net number of winners and losers selected by said player relative to the actual outcome of said sporting event games; and (i) repeating steps (d) through (h) during the entire season associated with the seasonal sporting event.

2. A method according to claim 1 wherein each player's performance is ranked first on the net number of selections of sporting event game winners and losers and then on the net number of assigned points accumulated.

3. A method according to claim 1 wherein the sporting event is football.

4. A method according to claim 2 wherein the sporting event is football.

* * * * *